US006655145B2

(12) United States Patent
Boardman

(10) Patent No.: US 6,655,145 B2
(45) Date of Patent: Dec. 2, 2003

(54) FUEL NOZZLE FOR A GAS TURBINE ENGINE

(75) Inventor: Gregory A. Boardman, Spring Valley, CA (US)

(73) Assignee: Solar Turbings Inc, San Diego, CA (US)

( * ) Notice: Subject to any disclaimer, the term of this patent is extended or adjusted under 35 U.S.C. 154(b) by 75 days.

(21) Appl. No.: 10/027,305

(22) Filed: Dec. 20, 2001

(65) Prior Publication Data

US 2003/0115884 A1 Jun. 26, 2003

(51) Int. Cl.[7] ..... F23R 3/14
(52) U.S. Cl. ..... 60/737; 60/742; 60/748
(58) Field of Search ..... 60/737, 742, 748

(56) References Cited

U.S. PATENT DOCUMENTS

| | | | | |
|---|---|---|---|---|
| 3,682,390 A | * | 8/1972 | Cheshire et al. | 60/748 |
| 4,589,260 A | * | 5/1986 | Krockow | 60/737 |
| 4,701,124 A | * | 10/1987 | Maghon et al. | 60/748 |
| 5,251,447 A | | 10/1993 | Joshi et al. | |
| 5,303,554 A | | 4/1994 | Faulkner | |
| 5,351,477 A | | 10/1994 | Joshi et al. | |
| 5,373,693 A | | 12/1994 | Zarzalis et al. | |
| 5,435,126 A | | 7/1995 | Beaudoin | |
| 5,647,200 A | | 7/1997 | Althaus | |
| 5,813,232 A | * | 9/1998 | Razdan et al. | 60/737 |
| 5,826,423 A | | 10/1998 | Lockyer et al. | |
| 6,073,436 A | | 6/2000 | Bell et al. | |
| 6,216,466 B1 | | 4/2001 | Alkabie | |
| 6,438,961 B2 | * | 8/2002 | Tuthill et al. | 60/748 |

FOREIGN PATENT DOCUMENTS

| | | |
|---|---|---|
| DE | 38 19898 | 12/1989 |
| EP | 0 747 636 | 12/1996 |
| JP | 60126521 | 6/1985 |
| JP | 60-126521 * | 7/1985 |

* cited by examiner

*Primary Examiner*—Ted Kim
(74) *Attorney, Agent, or Firm*—Keith P Roberson

(57) ABSTRACT

A fuel nozzle for a gas turbine engine injects a liquid fuel flow from a liquid fuel passage in the swirler vane. An air flow over the swirler vane atomizes the liquid fuel flow to form a fuel air mixture. The fuel nozzle eliminates the need for a conventional air blast atomizer.

13 Claims, 4 Drawing Sheets

FUEL NOZZLE FOR A GAS TURBINE ENGINE

TECHNICAL FIELD

This invention relates generally to a gas turbine engine and specifically to a fuel nozzle for the gas turbine engine for delivering a liquid fuel.

BACKGROUND

Modern gas turbine engines increasingly must meet conflicting standards of efficiency and emissions. Lean premixed prevaporized (LPP) combustion is one manner of greatly reducing emissions. In a LPP system, air and fuel are mixed upstream in advance of being exposed to an ignition source. A fuel air mixture having air in excess of that needed for combustion is formed. The excess air reduces temperature of combustion in a primary combustion zone and thus the production of NOx. An example of a lean premixed combustion system is shown in U.S. Pat. No. 5,826,423 issued to Lockyer et al on Oct. 27, 1998.

However, LPP combustion typically is less stable than a combustion system operating with an air fuel ratio near stoichiometric or in a rich condition. Weak extinction or extinguishing of the flame becomes more prevalent during lean premixed combustion. LPP combustion systems may use pilot injection of fuel to enrich the mixture and provide more stable combustion and avoid weak extinction limits. Further, LPP systems require additional time for the fuel to atomize and mix thoroughly with the air. The additional time allows an opportunity for localized autoignition of fuel droplets. A hot recirculating gas may also cause combustion of fuel causing a flashback phenomenon.

Due to the unstable nature of LPP combustion, making any changes in an air flow path through the combustion system typically requires extensive effort to avoid the problems set out above. One typical change may include changing fuels supplied for combustion. For instance, a lean premixed gaseous system may use a plurality of fuel spokes in a premixing region of a fuel injector. Switching that same combustion system to a LPP combustion system may create significant changes in air flow paths in the fuel nozzle. These changes in air flow paths may lead to instabilities as set out above.

The present invention is directed to overcoming one or more of the problems as set forth above.

SUMMARY OF THE INVENTION

In an embodiment of the present invention a fuel nozzle for a gas turbine engine has a center body. A barrel portion is positioned radially distal from the center body. At least one swirler vane is positioned between the center body and the barrel portion. The swirler vane has a pressure surface portion, a suction surface portion, a trailing edge distal from a leading edge. The pressure surface portion and the suction surface portion extend between the leading edge portion and the trailing edge portion. A liquid fuel passage passes through the swirler vane. A liquid fuel jet on either the pressure surface, the suction surface, or both fluidly communicates with the liquid fuel passage.

In another embodiment the present invention a method for operating a fuel nozzle for a gas turbine engine includes introducing a liquid fuel flow from the surface of a swirler vane. An air flow is directed across the swirler vane to atomize the fuel flow. The fuel flow and air flow then mix over some predetermined length L.

BRIEF DESCRIPTION OF THE DRAWINGS

FIG. 2 is a frontal view taken along line 3—3 of FIG. 2 of the fuel nozzle.

DETAILED DESCRIPTION

Figure 1:
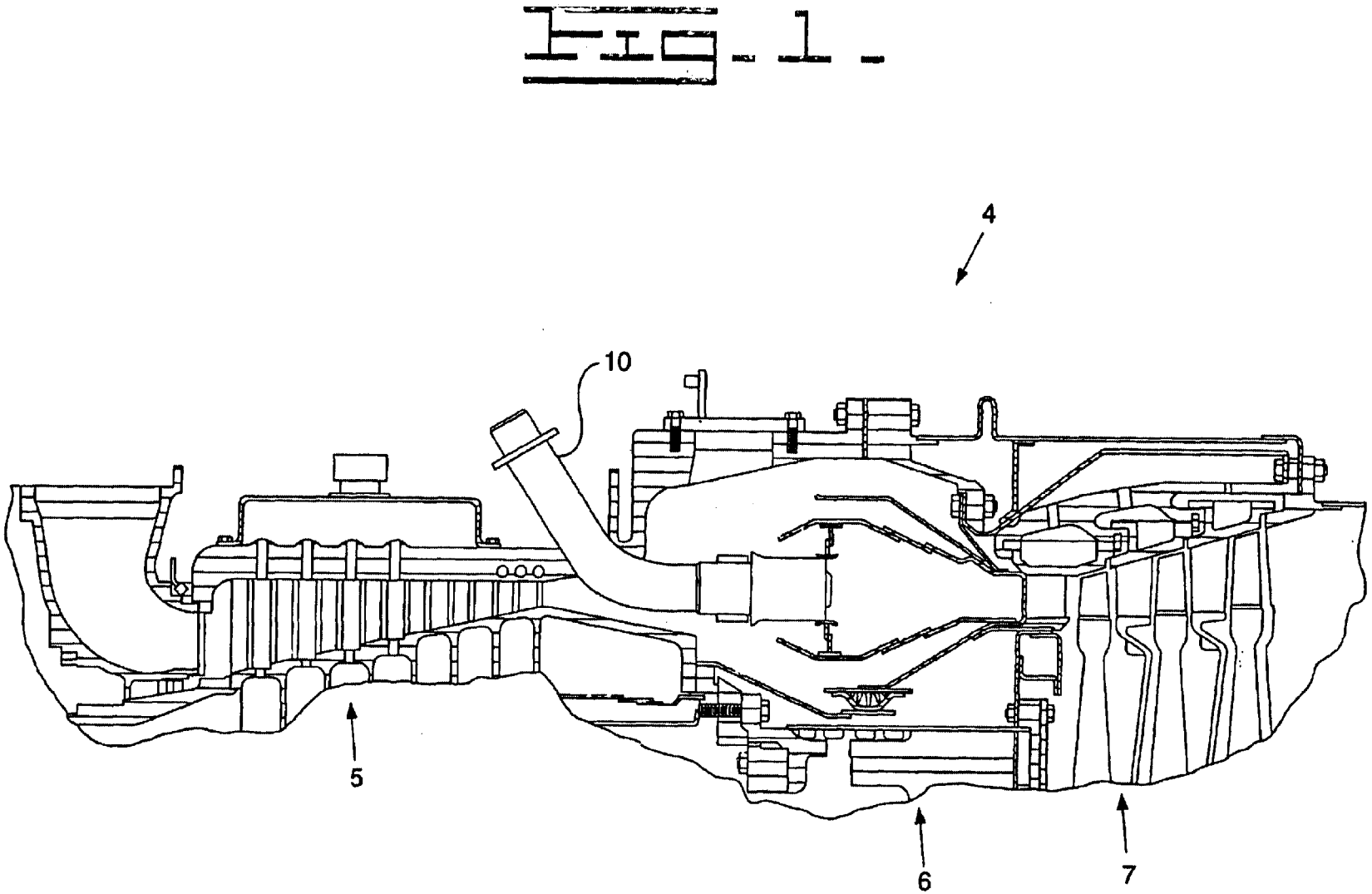
FIG. 1 is a cross section of a gas turbine engine embodying the present invention.

A gas turbine engine 4 shown in FIG. 1 includes a compressor section 5, combustor section 6, and turbine section 7. The combustor section 6 fluidly connects between the compressor section and turbine section. The combustor section includes at least one fuel nozzle 10.

Figure 2:
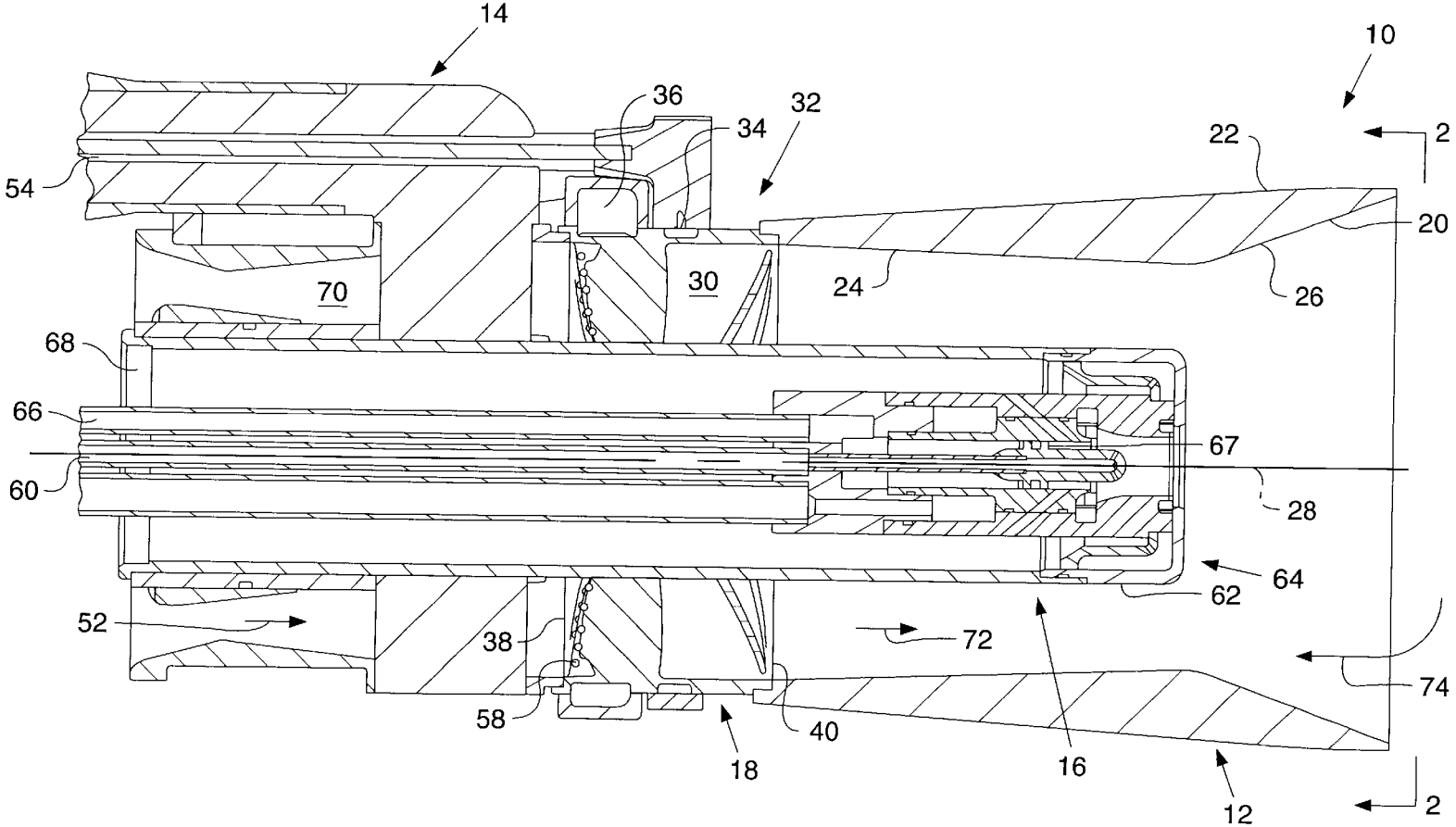
FIG. 2 is an exploded cross sectioned view of a fuel nozzle from the gas turbine engine embodying the present invention.

As shown in FIG. 2, the fuel nozzle 10 includes a barrel portion 12, a stem portion 14, a center body 16, and a swirler vane assembly 18. The barrel portion 12 is generally an annulus having an inner diameter 20 and outer diameter 22. In an embodiment, the inner diameter 20 has a converging portion 24 of a predetermined length L and a diverging portion 26. Alternatively the inner diameter 20 may be fixed. The outer diameter 22 in this embodiment is shown as diverging but could also be a fixed diameter or converging. The barrel portion 12 is generally aligned about a central axis 28. The barrel portion 12 connects with the swirler vane assembly 18 in a conventional manner.

Figure 3:
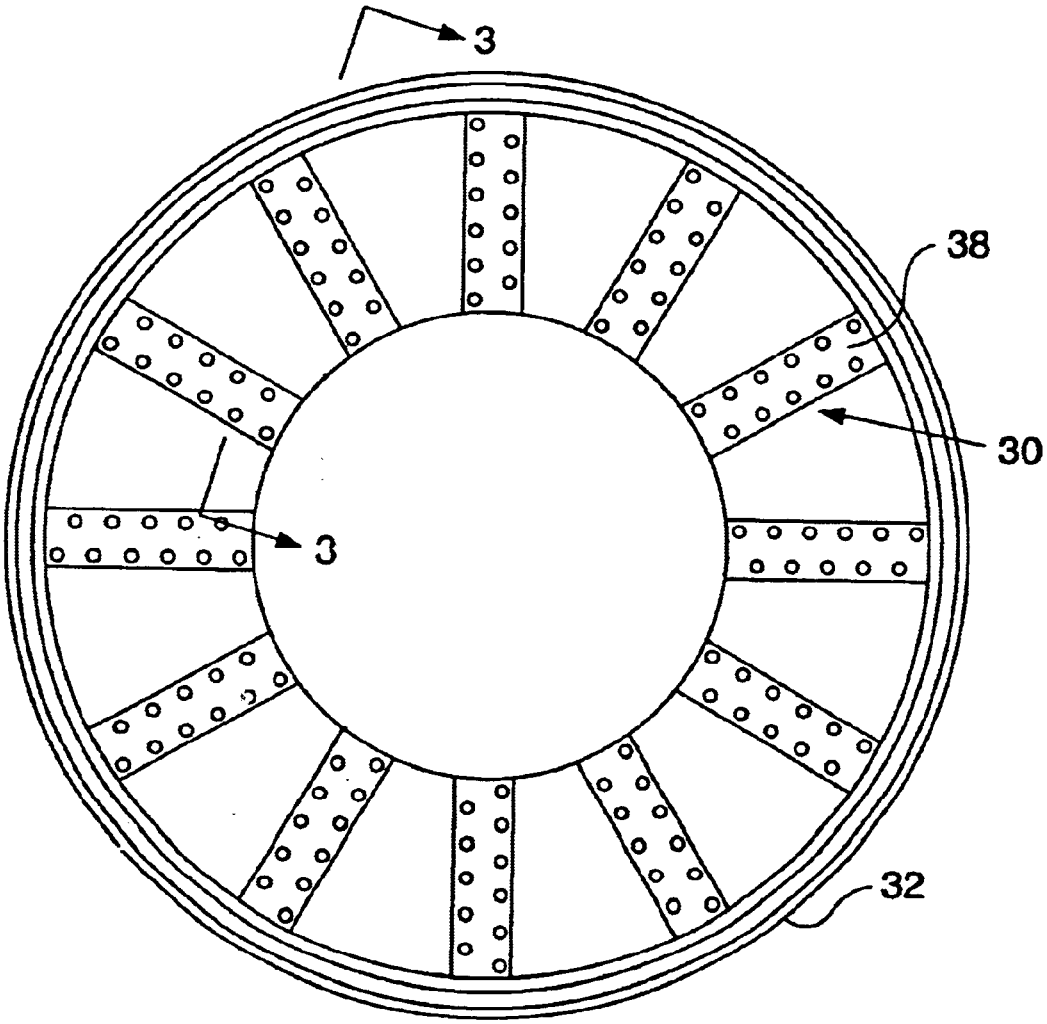
Figure 4:
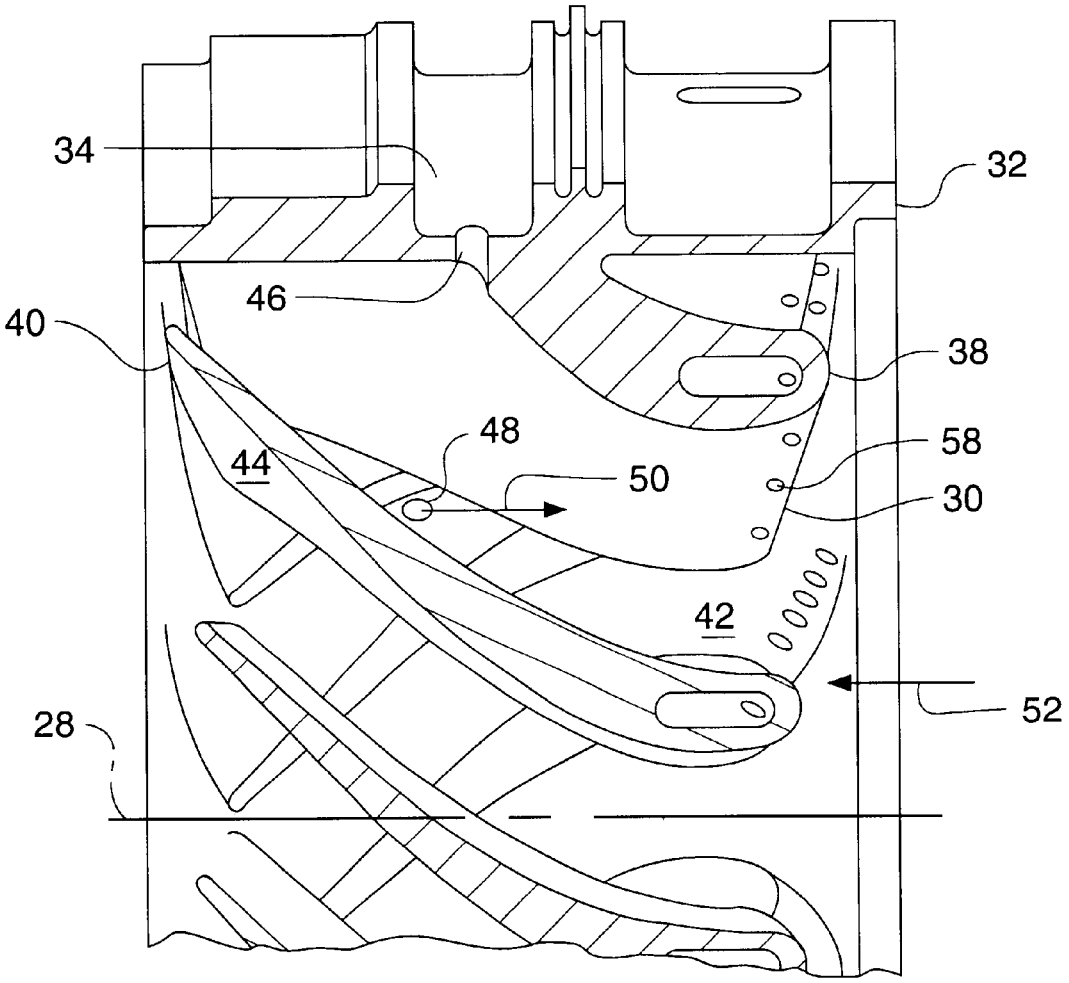
FIG. 4 is a view of a partially sectioned swirler vane of the present embodiment.

Looking to FIGS. 2–4, the swirler vane assembly 18 includes a plurality of swirler vanes 30 and a swirler vane ring 32. The swirler vane ring 32 is an annulus generally positioned about the central axis 28. The swirler vanes 30 extends radially inward from the swirler vane ring 32 towards the central axis. In this application, the swirler vanes 30 and swirler vane ring 32 are integral. However, the swirler vanes 30 and swirler vane ring 32 may be formed separately and connected in any conventional manner. A liquid fuel manifold 34 is formed in the swirler vane ring 32. Optionally, a second fuel manifold 36 may also be formed in the swirler vane ring 32. The second fuel manifold 36 may be suitable for a liquid or gaseous fuel. Both the liquid fuel manifold 34 and the second fuel manifold 36 fluidly communicate with the plurality of swirler vanes 30.

The plurality of swirler vanes 30 are best shown in FIG. 4 having a leading edge portion 38, trailing edge portion 40, pressure surface portion 42, and suction surface portion 44. The pressure surface portion 42 is generally a concave surface of an air foil type structure. The suction surface portion 44 is generally a convex surface of an air foil type structure. The pressure surface portion 42 and suction surface portion 44 connect at both the leading edge portion 38 and the trailing edge portion 40. The leading edge portion 38 is positioned upstream from the trailing edge portion 40. Each of the swirler vanes 30 includes a liquid fuel passage 46 passing between the suction surface 44 and pressure surface 42. The liquid fuel passage 46 connects in a conventional manner with the liquid fuel manifold 34. A liquid fuel jet 48 is positioned on the pressure surface portion 42 and is in fluid communication with the liquid fuel passage 46. Alternatively the liquid fuel jet 48 may also be placed on the suction surface portion 44 or both the suction surface portion 44 and pressure surface portion 42. The liquid fuel jet 48 may be an orifice, nozzle, atomizer, or any other conventional fluid passing means. In an embodiment, the liquid fuel jet 48 is nearer to the trailing edge 40 than the leading edge 38 and is radially about mid way between the swirler vane ring 32 and the center body 16. While the above embodiment only shows one liquid fuel jet 48 per swirler vane 30, multiple liquid fuel jets 48 or alternating liquid fuel jets 48 may be used where every other, every third, or every other multiple swirler vane 30 has a liquid fuel jet 48. The liquid fuel jet 48 in this application further shows introduction of a liquid fuel flow, illustrated by arrow 50. The liquid fuel flow 50 has an axial component of a velocity counter to an axial component of a velocity of an air flow, illustrated by arrow 52. In this application axial component refers only to the directional component of velocity not a magnitude of velocity.

As shown in an embodiment, the swirler vanes 30 may also include a second fuel passage 54 in fluid communication with the second fuel manifold 36 in the swirler vane ring 32. A plurality of orifices 58 formed on the leading edge portion 38 are fluidly connected with the second fuel passage 54. While FIG. 4 shows the orifices 58 on both the suction surface portion 44 and the pressure surface portion 42, it should be understood that the orifices may also be place on only the suction surface portion 44 or the pressure surface portion 42. Further, the orifices 58 may have regular or irregular spacing along the radial length of the leading edge portion 38 and the orifices 58 may be of equal or varying flow areas.

Returning to FIG. 2, the center body 16 is generally coaxial with the barrel portion 22. The swirler vanes 30 encircle the center body 16 and may be attached to the center body 16. While the present embodiment shows formation of the liquid fuel manifolds in the swirler vane ring, the liquid fluid passage may alternatively fluidly communicate with a liquid fuel passage 60 in the center body 16. The center body includes a pilot 62 having a tip portion 64. The pilot in an embodiment includes, the liquid fluid passage 60 and an air passage 68 in fluid communication near said tip portion. The center body 16 connects with the stem portion 14 in a conventional fashion. An air channel 70 is formed between the center body 16 and stem portion 14. Alternatively, the center body may further include a second fuel passage 66. The second fluid passage may include a plurality of fuel swirlers 67. As shown in this application, the pilot 62 may be describe as an air blast type atomizer. However, other pilot types may also be used such as a catalytic reactor, surface reactor, or liquid fuel jet.

While the stem portion 14, barrel portion 12, center body 16, and swirler vane assembly 18 are shown as separate parts, any one or more of the listed components may be integral with one another.

Industrial Applicability

In operation of the fuel nozzle 10, the air flow 52 moves through the air channel 70 towards the swirler vane assembly 18 at some axial velocity. The liquid fuel flow 50 leaves the pressure surface portion 42 into the air flow 52. As the air flow 52 passes over the swirler vanes 30 the air flow 52 air blasts the liquid fuel flow 50 atomizing the liquid fuel flow 50. To further enhance atomization, the liquid fuel jet 48 may impart an axial component to the velocity of liquid fluid flow 50 having an axial component of velocity counter to the axial component of velocity of the air flow 52.

Atomizing the fluid flow 50 using air flow 52 removes the need for using air blast atomizers in a fuel nozzle 10. Removing the air blast atomizers allow a gaseous only fuel nozzle and a duel fuel nozzle to use a common design with less redesign due to the disturbances in the air flow 52 caused by air blast atomizers. Further, removing air blast atomizers reduces compressed air needs further increasing efficiencies.

The barrel portion 12 provides for more stable combustion. The converging portion 24 accelerates a fuel air mixture 72 between said center body 16 and said converging portion over the length L. In an embodiment L defines an axial distance from the trailing edge 40 to the tip portion 56 of the center body. Accelerating the fuel air mixture 72 prevents a hot recirculating gas 74 from igniting the fuel air mixture 72 upstream of the tip portion or flashback.

With the present embodiment, the fuel air mixture 72 near the tip portion 64 is more completely mixed. The diverging portion 26 decelerate the fuel air mixture 72 after length L. Decelerating the fuel air mixture 72 allows for increased volumes of reciruclating gas 74 to ignite the fuel air mixture 72. Increasing the mass of recirculating gas 74 promotes flame stability by continually reigniting the fuel air mixture 72 and reducing chances of flame extinction.

Other aspects, objects and advantages of this invention can be obtained from a study of the drawings, the disclosure and the appended claims.

What is claimed is:

1. A fuel nozzle for a gas turbine engine, said fuel nozzle comprising:

a central axis;

a center body disposed about said central axis, said center body having a tip portion;

a barrel portion coaxial with said center body disposed radially distal from said center body, said barrel portion having an inner diameter and an outer diameter;

at least one swirler vane disposed between said center body and said barrel portion, said swirler vane having a trailing edge portion distal from a leading edge portion, said swirler vane having a pressure surface portion and a suction surface portion, said pressure surface portion and said suction surface portion extending between said leading edge portion and said trailing edge portion; and a liquid fuel passage disposed through said swirler vane;

a liquid fuel jet in fluid communication with said liquid fuel passage, said liquid fuel jet on at least one of said pressure surface portion or said suction surface portion; and a second fuel passage disposed through said swirler vane, said second fuel passage is in fluid communication with said leading edge portion of said swirler vane.

2. The fuel nozzle as set out in claim 1 wherein said liquid fuel jet is closer to the trailing edge portion than the leading edge portion.

3. The fuel nozzle as set out in claim 2 wherein said liquid fuel jet is radially near a midpoint between said center body and the inner diameter of said barrel portion.

4. The fuel nozzle as set out in claim 2 wherein said liquid fuel jet is adapted to create an axial component of velocity in a liquid fuel flow counter to an axial component of velocity in an air flow.

5. The fuel nozzle as set out in claim 1 wherein said second fuel passage is adapted to deliver a gaseous fuel.

6. The fuel nozzle as set out in claim 1 wherein a radial distance between said center body and the inner diameter of said barrel portion decreases over a predetermined length L.

7. The fuel nozzle as set out in claim 6 wherein said radial distance between said center body and said inner diameter of said barrel portion increases downstream of said predetermined length L.

8. The fuel nozzle as set out in claim 1 wherein said tip portion includes a pilot.

9. The fuel nozzle as set out in claim 8 wherein said pilot is an air blast fuel atomizer.

10. A swirler vane for a dual fuel nozzle, said swirler vane comprising:

a pressure surface portion;

a suction surface portion being connected to said pressure surface portion at a leading edge portion and a trailing edge portion;

a liquid fuel passage being disposed between said pressure surface portion and said suction surface portion;

a second fuel passage being disposed between said pressure surface portion and said suction surface portions;

a plurality of orifices at said leading edge portion, said plurality of orifices in fluid communication with said second fuel passage; and a liquid fuel jet in fluid communication with said liquid fuel passage, said liquid fuel jet being dispose on at least one of said pressure surface portion or said suction surface portion.

11. The swirler vane as set out in claim 10 wherein said liquid fuel jet is closer to the trailing edge portion than the leading edge portion.

12. The swirler vane as set out in claim 10 wherein said liquid fuel jet is adapted to direct a liquid fuel flow having an axial component of velocity counter to an axial component of velocity in an air flow.

13. A gas turbine engine having a fuel nozzle therein, said gas turbine engine comprising:

a compressor section;

a combustor section fluidly connected to said compressor section, said combustor section including said fuel nozzle, said fuel nozzle having a center body disposed about a central axis, a barrel portion coaxial with said centerbody, a plurality of swirler vanes disposed between said centerbody and said barrel portion, a liquid fuel passage disposed through said swirler vanes, a liquid fuel jet in fluid communication with said liquid fuel passage, said liquid fuel jet disposed about a surface of the swirler vane, a second fuel passage disposed through said swirler vane, said second fuel passage is in fluid communication with a leading edge portion of said swirler vane; and a turbine section in fluid communication with said combustor section.

* * * * *